US007159851B1

(12) United States Patent
Ross et al.

(10) Patent No.: US 7,159,851 B1
(45) Date of Patent: Jan. 9, 2007

(54) APPARATUS FOR DEPLOYING AND RETRIEVING WATER SAMPLER

(75) Inventors: Jerry H. Ross, Waveland, MS (US); Eugene C. Hayes, Diamondhead, MS (US); James C. Jelinski, Diamondhead, MS (US); Joseph N. Greulich, II, Picayune, MS (US)

(73) Assignee: The United States of America as represented by the Secretary of the Interior, Washington, DC (US)

( * ) Notice: Subject to any disclaimer, the term of this patent is extended or adjusted under 35 U.S.C. 154(b) by 308 days.

(21) Appl. No.: 10/985,065

(22) Filed: Nov. 10, 2004

(51) Int. Cl.
*B66D 1/50* (2006.01)

(52) U.S. Cl. ..... 254/275; 254/334; 254/378

(58) Field of Classification Search ..... 254/275, 254/325, 334, 362, 378
See application file for complete search history.

(56) References Cited

U.S. PATENT DOCUMENTS

| | | | | |
|---|---|---|---|---|
| 3,922,808 A | | 12/1975 | Rieth et al. | |
| 4,108,264 A | * | 8/1978 | Tanaka | 180/2.1 |
| 4,157,657 A | | 6/1979 | Hinchman | |
| 4,390,161 A | * | 6/1983 | Nelson | 254/356 |
| 4,547,857 A | | 10/1985 | Alexander | |
| 4,793,088 A | | 12/1988 | Fortuna | |
| 5,391,080 A | * | 2/1995 | Bernacki et al. | 434/254 |
| 5,570,303 A | | 10/1996 | Dessureault | |
| 7,080,825 B1 | * | 7/2006 | George et al. | 254/267 |
| 2003/0037602 A1 | | 2/2003 | Glasgow, Jr. et al. | |

* cited by examiner

*Primary Examiner*—Emmanuel M Marcelo
(74) *Attorney, Agent, or Firm*—Mark Homer; Joan Gilsdorf

(57) ABSTRACT

An apparatus includes a bi-directional DC motor; a gear reducer connected to the DC motor; a pulley mounted on an output of the gear reducer; an anti-back drive brake mounted on the output of the gear reducer; a reel wound with cable; a second pulley attached to the reel wound with cable; a belt for connecting the pulley and the second pulley; a water measuring device attached to an end of the cable wound on the reel; at least one shaft encoder attached to the motor for measuring the speed and direction of the motor; a DC power source connected to the DC motor; a microprocessor control electronics module connected to the at least one shaft encoder and the DC motor; and a remote control in communication with the microprocessor control electronics module.

6 Claims, 5 Drawing Sheets

APPARATUS FOR DEPLOYING AND RETRIEVING WATER SAMPLER

STATEMENT OF GOVERNMENT INTEREST

The invention described herein may be manufactured and used by or for the Government of the United States of America for government purposes without the payment of any royalties therefor.

BACKGROUND OF THE INVENTION

The invention relates in general to measurements of flowing water, such as rivers and streams, and in particular to depth-integrating sampling and the measurement of water velocity.

In performing depth-integrating sampling, large samplers weighing upwards to 135 lbs. are used to perform sampling of suspended sediment. This is done by attaching the sampler to a reel system (typically a United States Geological Survey B-56 or E-53 reel) and mounting the reel system to a truck or reel crane. The sampler is attached to the cable on the reel and manually deployed carefully to the surface of the water. Because the sampler requires a precise speed through the water column, a metronome or audio type sounding device is used to compare an elapsed time with the payout and retrieval rate of the cable from the reel. A mechanical brake held by the operator is often used to accomplish this task. However, such an operation is very imprecise and inaccurate often times resulting in the sampling bag being overfilled or under filled.

For most applications, the operator is required to hand-crank the sampler when retrieving. For deploying the sampler, the operator uses the reel brake to control the speed of the sampler as it moves through the water column to the specified depth. The speed of the sampler is determined by a fraction of the mean velocity of flow. Higher stream flow velocities require faster deploying and retrieval rates for the sampler. In many instances, the sampler is only deployed to a fraction of the total depth due to the physical demands during retrieval and the ability of the operator to accurately time the sampler in the water.

In another application, instruments for measuring water velocity at specific depths are used to determine a mean velocity of flow. To perform this operation, the instrument, depending on the total depth of the water, is attached to a sounding weight and lowered all the way to the bottom to determine depth. The instrument is then brought to the surface and a mechanical measuring dial on the reel is used to determine the total depth. The indicator is then reset and the instrument lowered to a predetermined depth position in the water column to make the measurement. Such an operation requires not less than two personnel to perform due to one person designated to operate the reel and brake and the other person observing the position of the water-measuring instrument.

Although this activity appears coordinated, the operation becomes intense due to the precise control of the reel and observation of the position being observed from the bridge or platform. In most cases, the positioning is imprecise. In some cases, the operation can become very hazardous due to instrument deployment on a cablecar system where only a single person is positioned in a cablecar and the cablecar deployed across the river. This activity can be risky due to logistical movement and deployment of the sampler or instrument from the cablecar. Hand cranking the reel is still required to retrieve the instrument.

Depth-integrating samplers and instruments for measuring water velocity and water quality parameters are in continuous development and improvement. Although these instruments have emerged with greater range and depth capability, the methods to deploy these systems have not followed suit. In particular, a new sampler capable of greater speed and depth capability has completed development but weighs nearly 300 lbs. Such a sampler cannot be deployed using present methods and techniques. The physical and strength requirements to deploy such an instrument are not practical and as a result have necessitated the development of a motor control system capable of controlled speed and rates to be fully usable for this application. There is no commercially available motor control system in the open market that can satisfy the operating requirements for this newly developed sampler. Without the development of the motor control system, the sampler cannot be used and measuring capabilities would be set back and limited to less capable samplers.

A prior art apparatus for improving these methods uses a DC motor attached to the reel or truck. The motor is unidirectional, meaning the motor can only be operated in one direction. Also, there is no present method or capability to control the speed or provide for any type of variable speed operation. Finally, no other ancillary information such as actual motor speed or line payout length is provided that can improve operating conditions. This lack of information can be an extreme hazard to the operator due to high rotating speeds when the motor becomes engaged and can damage instruments due to excessive speeds and torque applied. This jerking and stress also causes premature failure in the cable and total loss of the instrument package.

The only other method for use under these conditions is a larger and more complex hydraulic system used to control speed. Such a system requires considerable maintenance. Also, the system is large and bulky, requires petroleum fuel to run, and no operator display information is provided. Finally, the system is very expensive and significantly more complex to operate. The inventor is aware of no other mechanical, electromechanical, or hydraulic deployment method to improve data collection and efficiency except that previously described.

The present invention relieves the operator of the physical demands to raise and lower the sampler or sounding weight because a bi-directional operating DC motor performs control of the reel and cable. Also, the operator is able to perform full control of the reel and motor using a remote controlled unit containing a visual display that provides important information such as actual motor speed; amount of cable payout or cable reeled in, battery voltage, and other information necessary to perform the operation in a safe and efficient manner. Additionally, because the operator may use a remote controlled unit, only a single person is needed to perform the measurement since the remote controlled device allows the user to be located where the instrument or sampler being used is in full view. The ability to turn on and off the motor and control the speed precisely can all be done using the hand-held remote control and display unit.

Such an operation is significantly less hazardous since the operator does not need to be where the reel is located thereby reducing exposure to fast moving parts and cable. The invention has a wide operating range allowing the operator to select and monitor precise speed both in instrument deployment and retrieval. The invention can maintain a constant speed of cable payout and retrieval regardless of the size weight attached. A simple and easy rotating dial is used to select a constant motor speed.

Thousands of sites throughout the United States and in other foreign countries are used to conduct water sampling and water stream flow measurements performed by the hundreds each month. Using present methods, the time to conduct measurements involves a substantial amount of man-hours and manpower. Often, field operations utilize three or more people and the physical demands require above average strength. Use of the present invention can significantly improve the number of measurements that can be made over the same amount of time and dramatically improve the precision and quality of the measurement. Additionally, a significant safety improvement is realized due to quicker operation in conducting the measurement thereby reducing the risk of injury when handling heavy equipment and reducing the need for physical strength required to perform the operation. The cost savings realized by improving the speed and accuracy of the measurement is significant.

Further objects, features and advantages of the invention will become apparent from the following detailed description taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

The present invention can be used for the control of motor systems and cable reel systems used to deploy depth integrating samplers or other water measuring or water quality instruments. Operating information such as speed of cable payout or retrieval, amount of cable payout and direction of cable movement are available to the user. The apparatus can be used in many types of configurations to significantly improve the collection of important water data. Present methods and devices do not allow for precise motor control operations with speed information provided to the operator and often times results in inaccurate samples or measurements due to inability to control the speed of the motor and allow for bidirectional operation. The invention can be adapted to perform a wide variety of speed control functions.

The invention is adaptable to a variety of configurations and mountings. Examples include its use with depth integrating samplers where precise control of the speed of the sampler through the water column is required to insure a proper inflow sample of suspended sediment and water. Present methods do not allow for precise control of the speed and a display of speed information and often times results in overfilling or under filling the bag sample. Also, because the sampler is not moving through the water column evenly, the sampler collects more or less suspended sediment due to uneven progression through the regime. Other uses include mounting the system on a truck or crane where instruments are deployed from a bridge or other platform to conduct water data collection activities. A precise measurement of cable payout length is monitored by the invention and instruments can be precisely positioned where the measurement is to take place. Because there is no hand cranking of a cable reel required, the operation can be performed by any person without consideration of physical strength. Additionally, the operator is freed from attention to mechanical braking by operating the system using a wired or wireless hand-held remote control and display unit.

Figure 1:
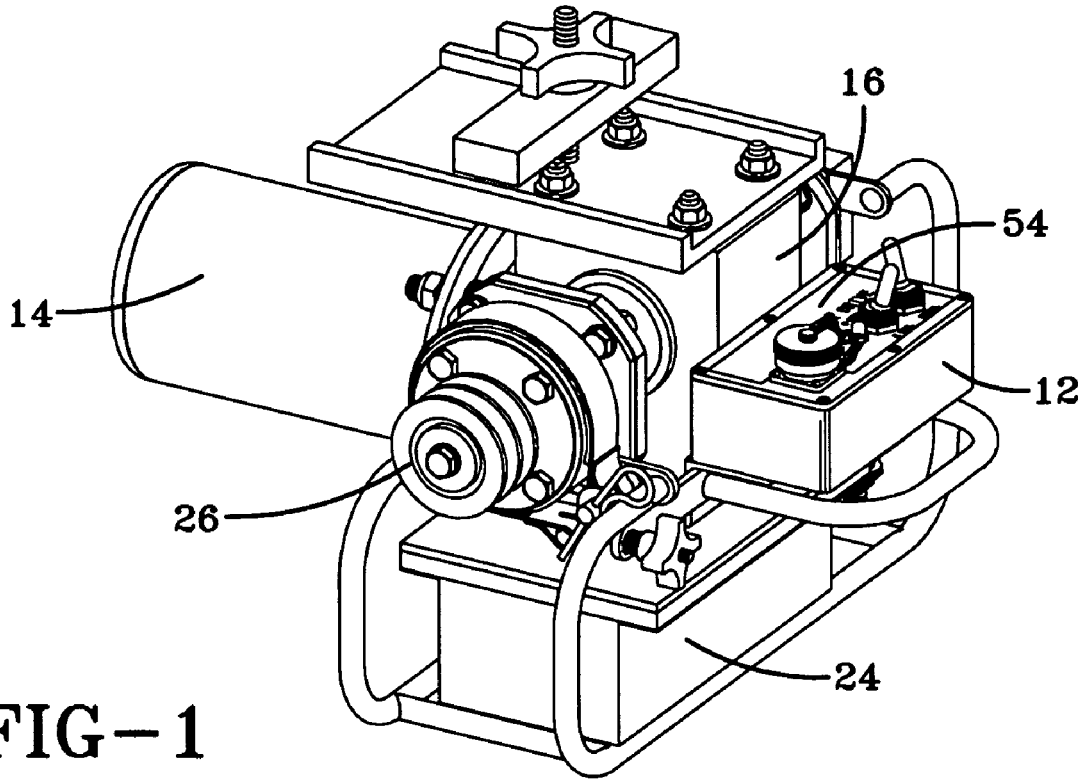
FIG. 1 is a perspective view of a portion of the inventive apparatus.
Figure 2:
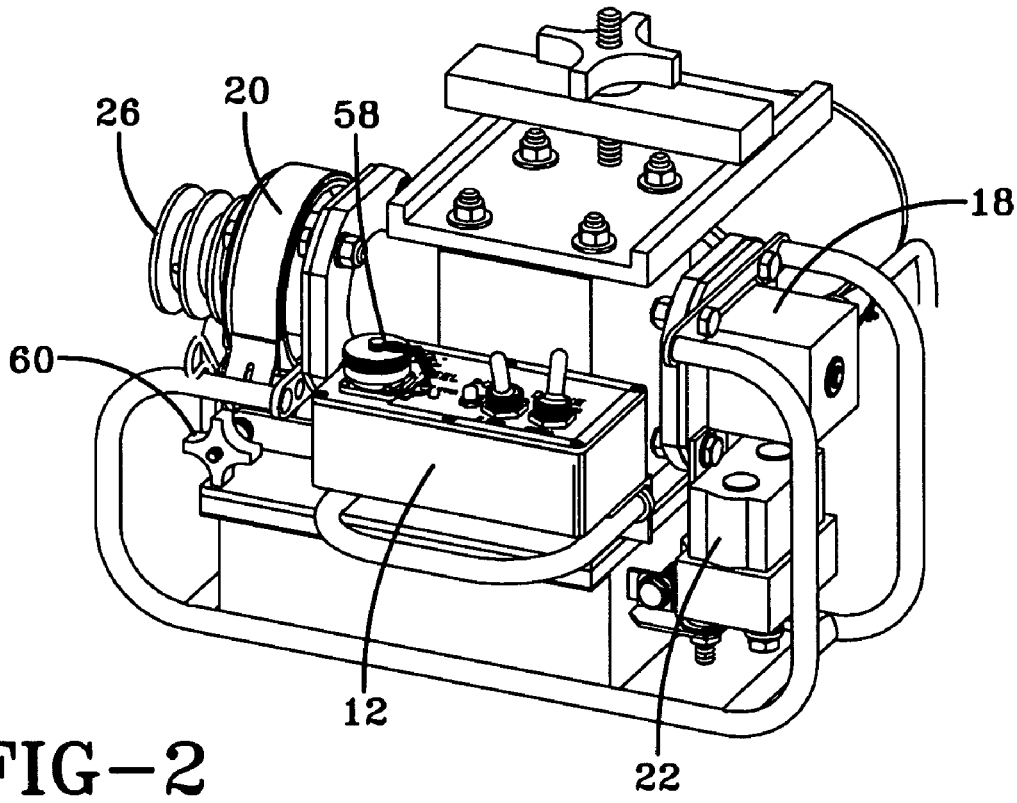
FIG. 2 is a perspective view of FIG. 1.

FIGS. 1 and 2 are perspective views of a portion of the invention. FIGS. 1 and 2 show a high-torque DC series wound motor 14, a microprocessor control electronic module 12, a gear reduction unit 16, a rotating shaft encoder 18, a motor contactor switch 22, an anti-backdrive brake 20, a motor pulley 26, a high current motor driver 24, a front panel 54 of the microprocessor control electronic module 12, a connection 58 for a remote control unit and an anti-backdrive brake adjustment 60.

Figure 3:
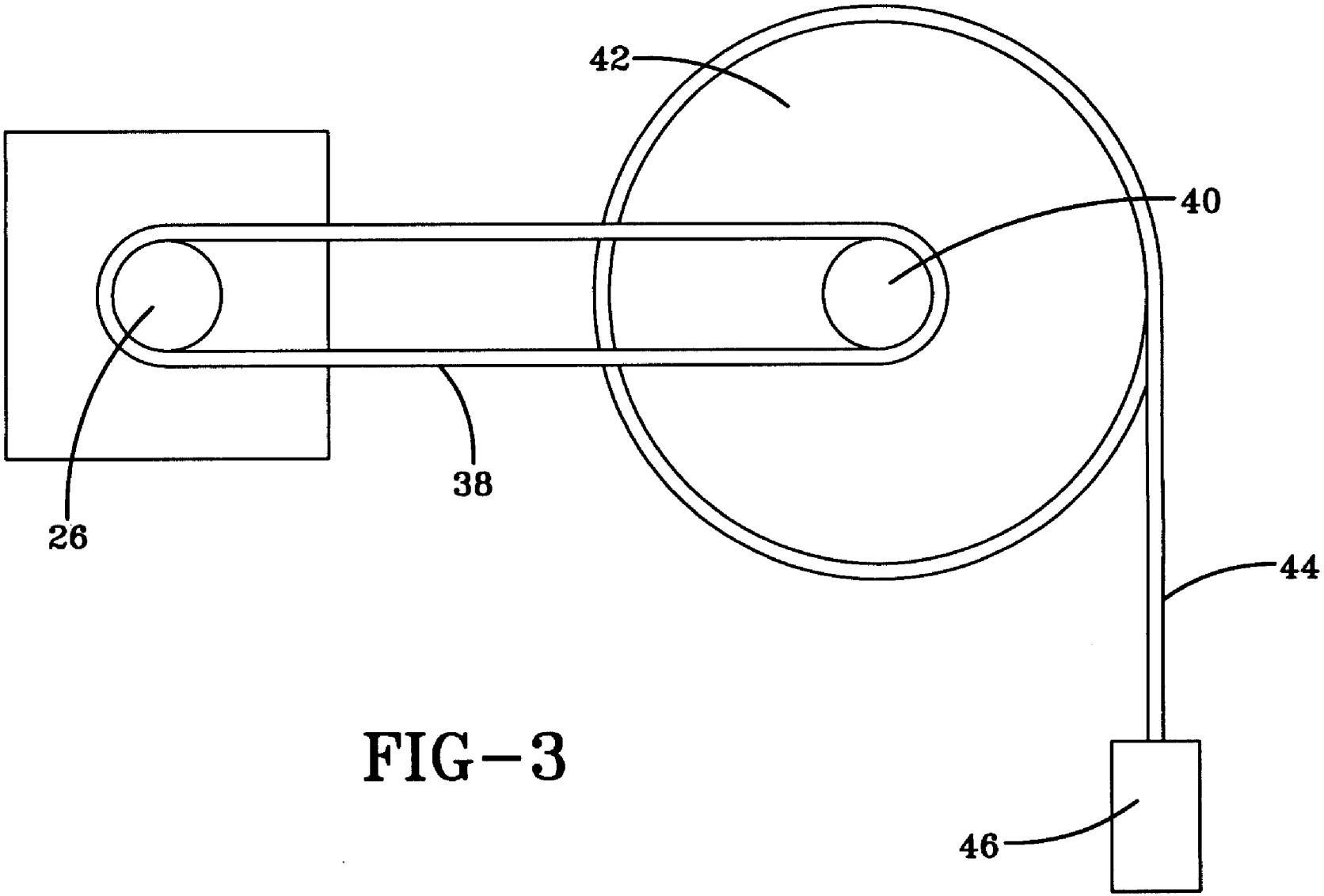
FIG. 3 is a schematic drawing of the invention.
Figure 4:
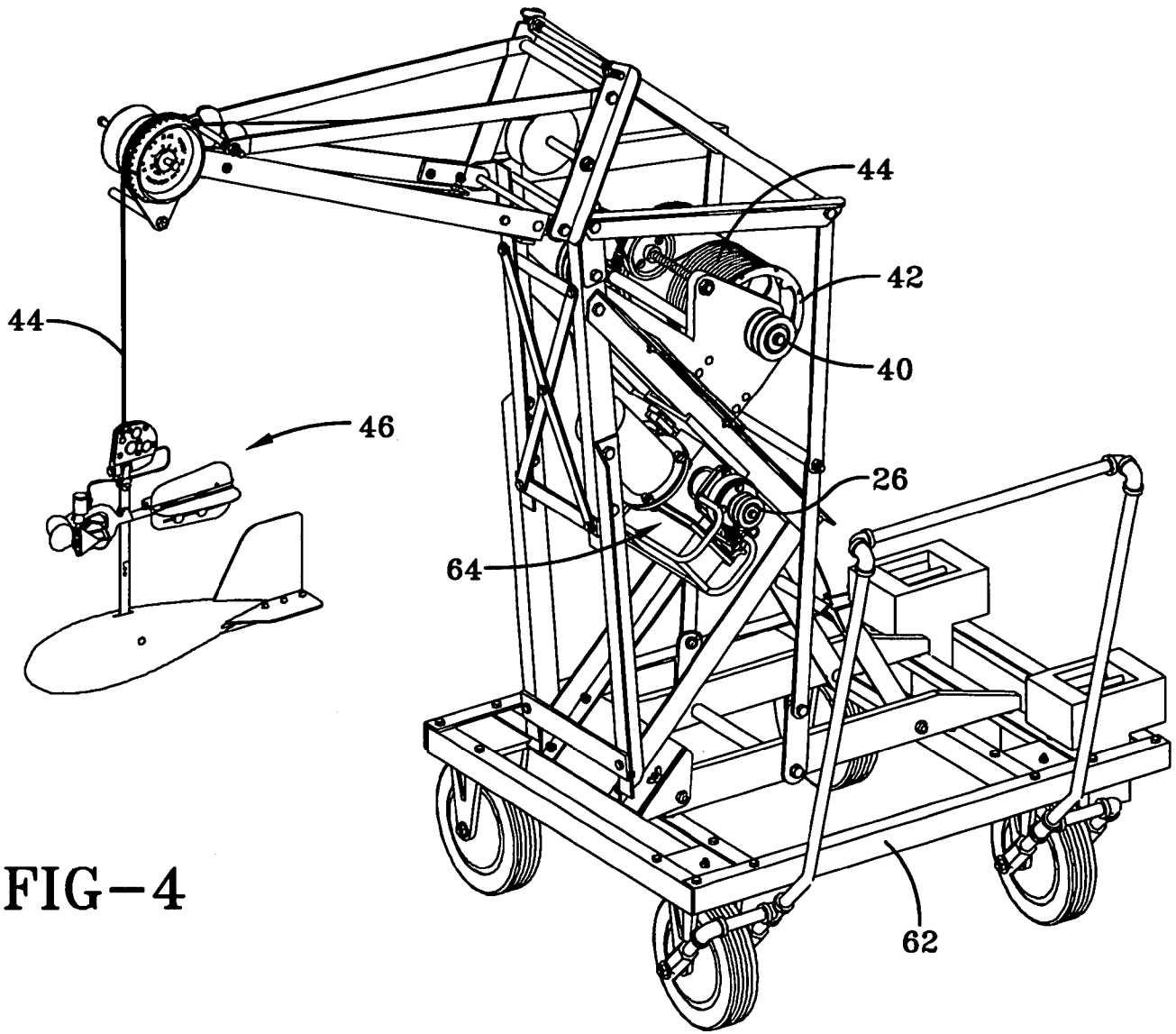
FIG. 4 is a perspective view of one embodiment of the invention.

FIG. 3 is a schematic drawing of the invention. FIG. 3 shows a motor pulley 26 connected by a belt 38 to a second pulley 40. Second pulley 40 rotates with drum 42. On drum 42 is wound cable 44. Attached to cable 44 is a water measuring device 46 that may be, for example, a water quality sampler. FIG. 4 is a perspective view of an embodiment of the invention mounted on a wheeled crane 62. The features shown in FIGS. 1 and 2 are generally attached to the wheeled crane 62 at 64. Mounted on wheeled crane 62 are the drum 42 wound with cable 44. Attached to the end of cable 44 is water quality sampler or measuring instrument 46. Belt 38 is not shown in FIG. 4.

Figure 5:
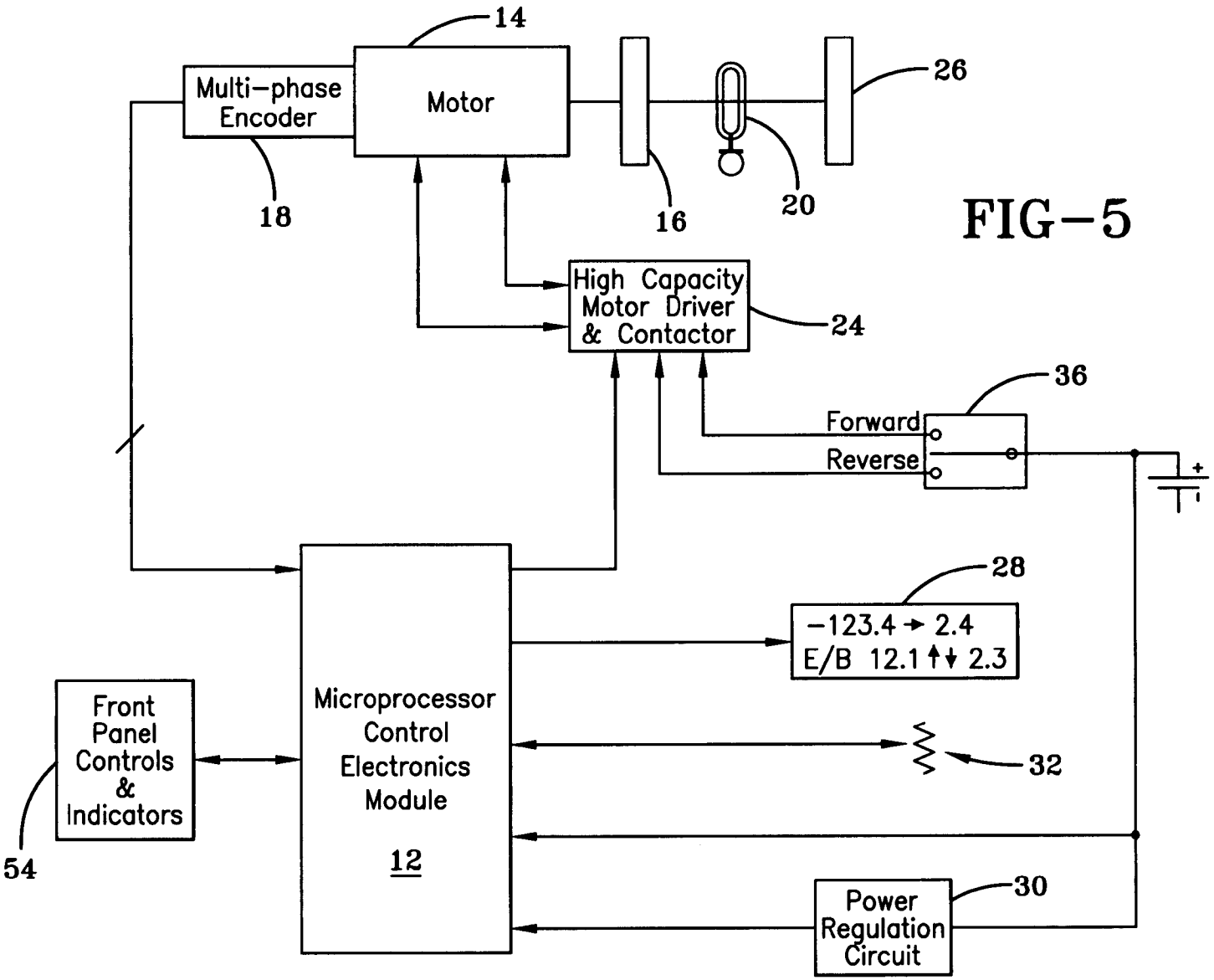
FIG. 5 is a block diagram of the invention.
Figure 6:
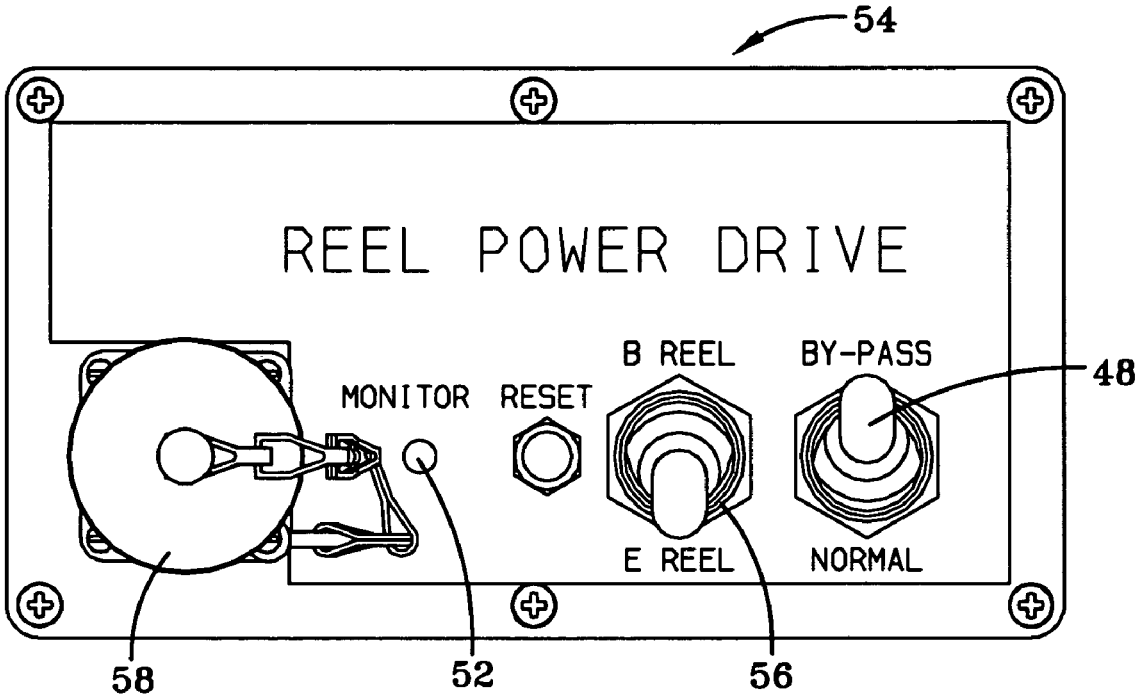
FIG. 6 is an enlarged view of the controls located at the motor.
Figure 7:
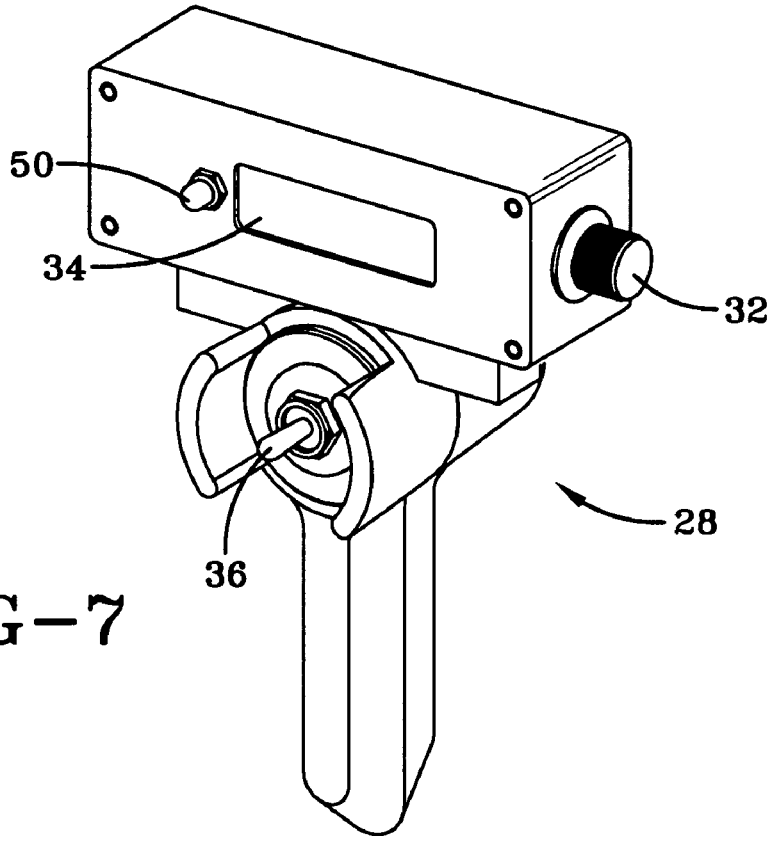
FIG. 7 is a perspective view of a remote control.

FIG. 5 is a block diagram of the invention. FIG. 6 is a view of the control panel 54 located near the motor 14 on the microprocessor control electronics module 12. FIG. 7 is a view of the hand-held remote control 28. FIG. 5 shows a microprocessor control electronics module 12, a high torque DC series wound motor 14, a gear reduction unit 16, multiple phase shaft encoders 18, an anti-backdrive brake 20, a motor contactor assembly 22, a high capacity motor driver 24, a motor pulley 26, a remote control and display unit 28, and a power regulation circuit 30.

The microprocessor control electronics module 12 is the primary device for control of the motor 14 and also provides information to the operator via the remote control and display unit 28. The microprocessor control electronics module 12 comprises a microprocessor integrated together with other controls, indicators, switches, a display and software to form a motor control apparatus that can read a speed setting input by the operator and control the motor at a constant rate of rotation in a bidirectional manner. A remote control and display unit 28 (FIG. 7) may be connected by a wire to the microprocessor control electronics module 12 at connection 58 (FIG. 2) or may operate using known wireless technology.

The operator, using the remote control and display unit 28 (FIG. 7) uses a control 32 to dial or select a desired motor speed. As the operator rotates the dial or control 32, the microprocessor control electronics module 12 senses the position of the control 32 and updates a speed number presented to the operator on a small, compact display 34. The display 34 shows a range of numbers representing the desired speed. When the operator determines the selection of speed, the operator then depresses the motor operate switch 36 in one of two possible positions. Each position determines the direction of the motor 14. As an example, the motor shaft will rotate counterclockwise when the switch 36 is pushed up. When the switch 36 is pushed down, the motor shaft will rotate in a clockwise direction. The switch 36 is designed so that whenever the switch is released, the switch is positioned in a center détente position stopping the motor 14. This safety feature is important to insure the motor 14 is not operating whenever the operator releases the switch 36 and the operator must drop or let go of the remote control and display unit 28.

The motor 14 is engaged with power and the motor windings properly polarized for rotating direction by the motor contactor assembly 22. When the motor 14 becomes engaged, one or more multiple phase shaft encoders 18 mechanically or optically coupled to the motor shaft provide electronic signals that indicate the position of the motor shaft. As the motor shaft rotates faster, the signals from the multiple phase shaft encoders 18 reflect a faster pulsing or voltage level position of the motor shaft. These signals are connected to the microprocessor control electronics module 12 that senses the speed and position of the shaft and through software, directs a control voltage or signal to the high capacity motor driver 24. The high capacity motor driver 24 provides the driving signals (either in the form of a constant or frequency modulated voltage or current signal) to the DC motor 14 to energize the windings and cause rotation.

By sensing the signals from the multiple phase shaft encoders 18, the microprocessor control electronics module 12 is able to maintain and control the rotation speed of the motor 14 irrespective of the weight 46 attached to the motor pulley 26 (See FIG. 3). Also, by reading the signals from the multiple phase shaft encoders 18, the microprocessor control electronics module 12 is able to measure and compute the actual speed of the motor 14 and present the information to the operator on the display 34. Also, the microprocessor control electronics module 12 is able to indicate the rotation direction to the operator on the display 34. Different gear reduction units 16 can be used to increase or reduce the rotation speed range of the motor shaft. One preferred embodiment uses a reduction of 5:1.

Another feature of the invention is the ability to display motor direction and speed even if the motor 14 is not energized with power (i.e., rotating freely). Because the multiple phase shaft encoders 18 work independent of the energy applied to the motor 14, information about motor rotation speed and direction can be obtained and presented to the display 34. Whenever variations to motor speed are detected by the microprocessor control electronics module 12, the microprocessor continually adjusts the drive to the motor up or down to keep the speed constant.

A unique feature of the invention is an operating mode that provides a backup capability in the event the microprocessor 12 and supporting electronics fails, or merely to provide simple operation of the motor 14 without the need for constant speed control. This feature is selected by a mechanical switch 48 (FIG. 6) on the microprocessor control electronics module 12 that bypasses signals controlling the motor 14 by the microprocessor 12 and connects a simple control to the motor driver 24 to drive the motor 14. This feature uses the same control that allows the operator to select a speed rate and connects the control directly to the motor driver 24. Although constant speed is not provided in this mode of operation, since the microprocessor control electronics module 12 is removed from the control circuit, the motor 14 can be varied in speed by simply rotating the control 32. If the microprocessor control electronics module 12 is operating properly, the microprocessor reads the speed rate signals from the multiple phase shaft encoders 18 and reports the speed and direction of rotation to the display 34.

An important feature of the invention is the ability to monitor and maintain the amount of cable 44 (FIG. 3) being reeled out of or retrieved onto the cable reel or drum 42. This feature is called 'Line Length' and is continually monitored and shown on display 34 anytime the motor shaft is rotating in either direction. On the remote control and display unit 28 (FIG. 7), a single switch 50 can 'zero' the Line Length value to establish a reference when water quality samplers or other water measuring instruments are deployed. The switch 50 also functions to provide the operator different types of motor control selections such as pulley size, for example.

Indicators on the front panel 54 (FIG. 6) of the microprocessor control electronics module 12 are provided to show the operating state and conditions of the invention. For example, if the motor 14 is running at the selected speed, the indicator 52 will show a specific color such as green. If the motor 14 is not operating at the selected speed, the indicator 52 will show red, or a blinking red condition and so forth. Switch 56 on the front panel 54 enables one to select the size of the reel or drum 42 that is being used and to program the microprocessor control electronics module 12 accordingly. Switch 48 allows one to select either a manual (bypass mode) or constant speed operating mode. Selection of the size pulley 26 used in the invention can be performed by a switch 50 selection or a printed circuit board strap selection. The selections just described are needed to insure that the microprocessor control electronics module 12 measures and calculates the proper speed drive signals and amount of cable 44 reeled out or retrieved.

The power regulation circuit 30 provides the constant power required by the microprocessor control electronics module 12 and supporting circuitry. The power regulation circuit 30 has a wide input power operating range allowing for wide ranges of input voltage operation.

The invention includes an adjustable mechanical brake 20 called an anti-backdrive brake. The anti-backdrive brake 20 prevents the back rotation of the motor shaft whenever an attached weight 46 is sufficient to cause rotation of the motor shaft even if power is not engaged to the motor 14. Because the motor shaft can rotate in either direction, when sufficient weight 46 is attached to the cable 44 through the pulley system, the motor shaft can rotate without power being applied. The speed of rotation can be significant. To counteract the rotation, a mechanical (or electrically engaged) anti-backdrive brake 20 provides sufficient anti-rotation friction through a brake drum (or brake disc) to prevent rotation. When the motor 14 becomes engaged, the high torque nature of the motor is sufficient to overcome the backdrive friction and the motor rotates the shaft and pulley in the desired direction. The brake 20 automatically partially releases when the motor 14 is rotating in the direction where cable 44 is spooling onto the reel 42. This partial release helps reduce the brake friction during cable retrieval and reduce the amount of power to overcome braking. The anti-backdrive brake 20 is easily set by suspending the weight (sediment sampler or instrument) 46 and adjusting the braking control knob 60 (FIG. 2) until rotation is stopped.

Some advantages of the invention over the prior art are the ability to select the desired speed, review, observe, and monitor motor selections, cable length, and motor operations, and control the motor with a single hand-held control. The hand-held control 28 can be remote from the motor 14 and reel 42 and positioned where the sampler or instrument 46 can be easily viewed. An important safety feature is the adjustable anti-backdrive brake 20 that prevents motor rotation when an attached weight 46 can cause motor rotation without any power applied to the motor. Another important feature is the ability to bypass microprocessor control (if in the event of some electronics failure) or to simply operate the motor in a non-constant speed of operation. This feature is extremely important when adjusting the sampler or instrument 46 to a specific position and when constant speed control is not required.

Again, an important feature is the bi-directional control of the motor 14 and the ability to provide constant and variable speed control in either direction of rotation. In the constant speed mode of operation, the motor speed rate can be adjusted dynamically allowing the motor 14 to adjust to a new speed setting while the motor is engaged and running. This feature is very important when the operator observes debris in the water flow and must take safety precautions to extract the instrument or sampler 46 as quickly as possible to avoid damage or loss of the instrument or sampler. The invention can operate using a wide range DC power source rather than high voltage AC.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. An apparatus, comprising:

a bi-directional DC motor;

a gear reducer connected to the DC motor;

a pulley mounted on an output of the gear reducer;

an anti-back drive brake mounted on the output of the gear reducer;

a reel wound with cable;

a second pulley attached to the reel wound with cable;

a belt for connecting the pulley and the second pulley;

a water measuring device attached to an end of the cable wound on the reel;

at least one shaft encoder attached to the motor for measuring the speed and direction of the motor;

a DC power source connected to the DC motor;

a microprocessor control electronics module connected to the at least one shaft encoder and the DC motor; and a remote control in communication with the microprocessor control electronics module, the remote control including a motor speed selector, the microprocessor control electronics module controlling a speed of the DC motor in either direction based on a setting of the motor speed selector and feedback from the at least one shaft encoder, the microprocessor control electronics module calculating speed corrections and an amount of the cable unwound or retrieved from the reel.

2. The apparatus of claim 1 wherein the remote control communicates with the microprocessor control electronics module via a wired connection.

3. The apparatus of claim 1 wherein the remote control communicates with the microprocessor control electronics module via a wireless connection.

4. The apparatus of claim 1 wherein the remote control includes a motor on/off switch and a display for displaying motor speed and the amount of cable unwound from the reel.

5. The apparatus of claim 1 wherein the anti-back drive brake includes a brake adjustment to compensate for a weight of the water measuring device.

6. The apparatus of claim 1 wherein the motor speed selector on the remote control is operable to variably control motor speed in either direction independently from the microprocessor control electronics module.

* * * * *